US010852672B2

(12) United States Patent
Ishikawa

(10) Patent No.: US 10,852,672 B2
(45) Date of Patent: Dec. 1, 2020

(54) POWER SUPPLY DEVICE AND IMAGE FORMING APPARATUS

(71) Applicant: CANON KABUSHIKI KAISHA, Tokyo (JP)

(72) Inventor: Junji Ishikawa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/574,809

(22) Filed: Sep. 18, 2019

(65) Prior Publication Data

US 2020/0096920 A1 Mar. 26, 2020

(30) Foreign Application Priority Data

Sep. 20, 2018 (JP) ..... 2018-176291

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ..... G03G 15/80; G03G 15/2039
See application file for complete search history.

(56) References Cited

U.S. PATENT DOCUMENTS 10,423,116 B2 * 9/2019 Ishikawa ..... H02M 5/293
2015/0168889 A1 * 6/2015 Kita ..... G03G 15/2039 399/33
2017/0343959 A1 * 11/2017 Choi ..... G03G 15/2039
2018/0267447 A1 * 9/2018 Kato ..... G03G 15/2039

FOREIGN PATENT DOCUMENTS

JP 2005-315961 A 11/2005

* cited by examiner

*Primary Examiner* — Joseph S Wong
(74) *Attorney, Agent, or Firm* — Canon U.S.A., Inc. IP Division

(57) ABSTRACT

A power supply device includes a first circuit, a second circuit and a second detector. The first circuit includes an adjustment unit, a first controller which controls the adjustment unit, a first detector which detects a parameter about electric power supplied to a load, a first communication unit. The second circuit includes a second communication unit which performs wireless communication with the first communication unit and a second controller. The second detector detects a temperature of the load. The first controller is operated by electric power supplied thereto by a voltage output to the second communication unit. The first communication unit transmits information about a result of detection by the first detector to the second communication unit. The second controller controls the first controller via the first communication unit and the second communication unit based on the information. In a case where the temperature is higher than a predetermined temperature, supplying of the electric power is blocked off.

19 Claims, 6 Drawing Sheets

318
FIXING DEVICE
5 V
24 V
163
AC/DC POWER SOURCE
161
161a
HEATING ELEMENT
154
THERMISTOR
R4
5 V
GND
Vt
153
A/D CONVERTER
160a
TRIAC
167
H-ON
166
ABNORMALITY DETERMINATION UNIT
164a
164b
A/D CONVERTER
MEMORY
R3
I
ANT
SW
L1
L2
151a
MEMORY
ZX
CPU
160
R1
R2
V
FIRST CONTROL UNIT
SECOND CONTROL UNIT
165a
5 V
5 V
164
165
160b
1
PRIMARY
SECONDARY

POWER SUPPLY DEVICE AND IMAGE FORMING APPARATUS

BACKGROUND

Field

Aspects of the embodiments generally relate to a power supply device which controls electric power to be supplied to a load, and to an image forming apparatus which includes the power supply device.

Description of the Related Art

Heretofore, in a power supply device which operates with electric power supplied from a commercial power source, there is a known configuration which controls electric power to be supplied to a load by detecting the temperature of the load with a secondary-side circuit insulated from a primary-side circuit to which the commercial power source is connected and controlling the primary-side circuit based on a result of detection of the temperature.

For example, Japanese Patent Application Laid-Open No. 2005-315961 discusses a configuration which controls, in an image forming apparatus, electric power to be supplied to a heater by causing a main body control unit provided at a secondary side to control an induction heating (IH) control unit provided at a primary side via an insulated circuit unit such as a photocoupler or transformer.

In the configuration discussed in Japanese Patent Application Laid-Open No. 2005-315961, for example, if the IH control unit malfunctions, it becomes impossible to appropriately control electric power to be supplied to a load. Thus, if the IH control unit malfunctions, it becomes impossible to block off electric power to be supplied to a load, so that excess electric power may be supplied to the load and, therefore, power consumption may increase.

SUMMARY

Aspects of the embodiments are generally directed to preventing or reducing power consumption from increasing, even when a first circuit malfunctions.

According to an aspect of the embodiments, a power supply device has a first circuit connected to a predetermined power source, a second circuit insulated from the first circuit, and a second detector. The first circuit includes an adjustment unit, a first controller, a first detector, a first communication unit. The second circuit includes a second communication unit and a second controller. The adjustment unit is configured to adjust electric power to be supplied from the predetermined power source to a load. The first controller is configured to control the adjustment unit. The first detector is configured to detect a parameter about electric power supplied to the load. The first communication unit is connected to the first controller. The second communication unit is insulated from the first communication unit, and is configured to perform wireless communication with the first communication unit. The second controller is connected to the second communication unit. The second detector is configured to detect a temperature of the load. The first controller is operated by electric power supplied thereto by a voltage generated in the first communication unit due to a voltage output from the second controller to the second communication unit. The first communication unit transmits information about a result of detection by the first detector to the second communication unit by the wireless communication. The second controller supplies, to the first controller via the first communication unit and the second communication unit, a first signal for reducing a deviation between a target temperature of the load and the temperature detected by the second detector based on the information transmitted from the first communication unit to the second communication unit. The first controller controls the adjustment unit based on the first signal. In a case where the temperature detected by the second detector is higher than a predetermined temperature which is greater than the target temperature, supplying of the electric power to the first controller is blocked off.

Further features of the disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings. However, for example, the shape and relative location of each constituent component described in the exemplary embodiments can be altered or modified as appropriate according to the configuration or various conditions of a device or apparatus to which the disclosure is applied, and the scope of the disclosure should not be construed to be limited to the exemplary embodiments described below.

<Image Forming Apparatus>

Figure 1:
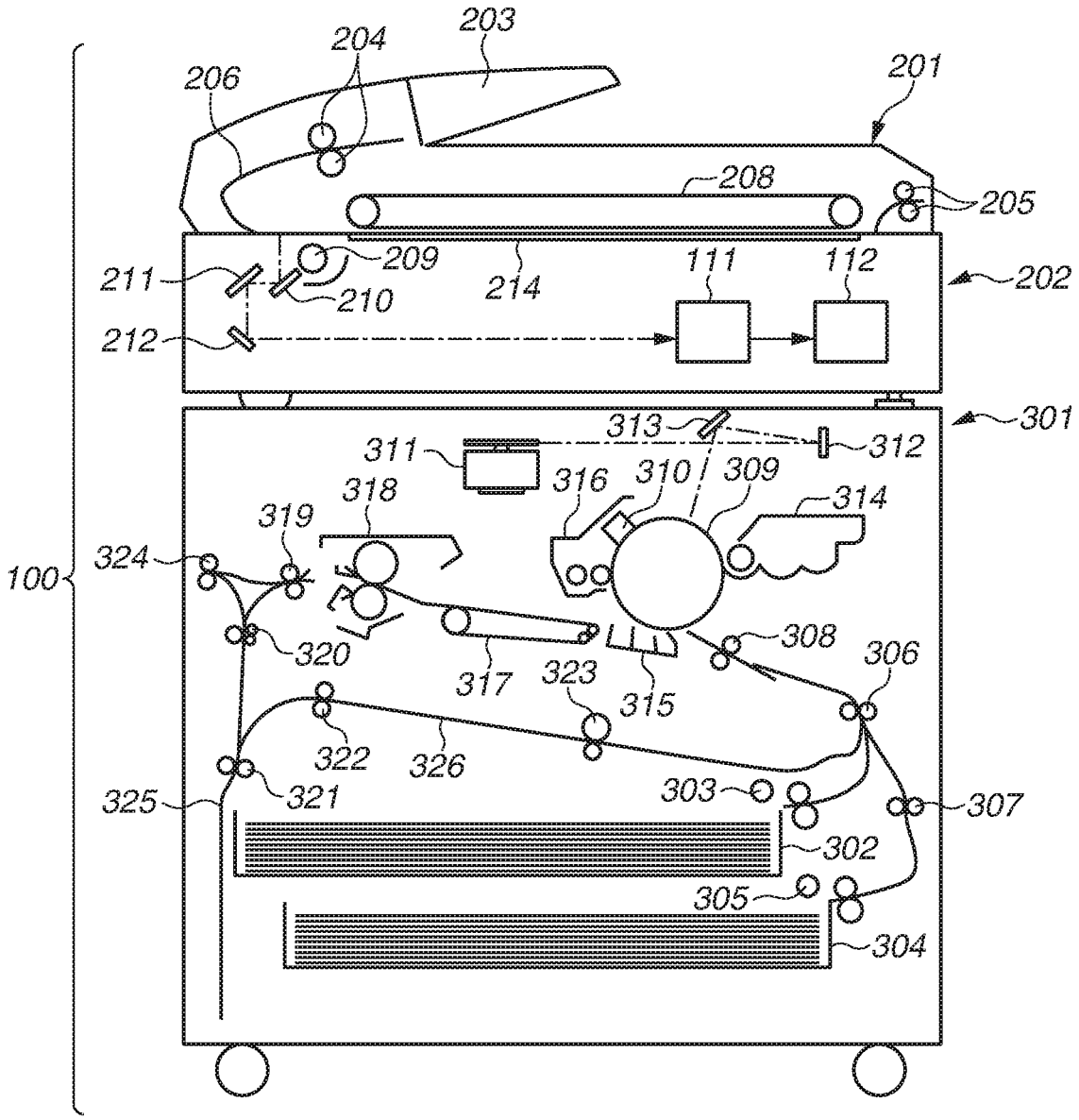
FIG. 1 is a sectional view illustrating an image forming apparatus according to a first exemplary embodiment.

FIG. 1 is a sectional view illustrating a configuration of an electrophotographic system monochrome copying machine (hereinafter referred to as an "image forming apparatus") 100 including a sheet conveyance device, which is used in an exemplary embodiment of the disclosure. Furthermore, the image forming apparatus is not limited to a copying machine, but can be, for example, a facsimile apparatus, a printing machine, or a printer. Moreover, the recording method is not limited to the electrophotographic system, but can be, for example, the inkjet system. Additionally, the type of the image forming apparatus can be any one of the monochrome and color types.

In the subsequent description, a configuration and functions of the image forming apparatus 100 are described with reference to FIG. 1. As illustrated in FIG. 1, the image forming apparatus 100 includes a document feeding device 201, a reading device 202, and an image printing device 301.

A document stacked on a document stacking portion 203 of the document feeding device 201 is fed by sheet feeding rollers 204 on a sheet-by-sheet basis and is then conveyed onto a document glass plate 214 of the reading device 202 along a conveyance guide 206. The document is further conveyed by a conveyance belt 208 at a fixed speed and is then discharged to a sheet discharge tray (not illustrated) by sheet discharge rollers 205. Reflected light from an image of the document illuminated by an illumination system 209 at the reading position of the reading device 202 is guided to an image reading unit 111 by an optical system including reflection mirrors 210, 211, and 212, and is then converted into an image signal by the image reading unit 111. The image reading unit 111 is configured with, for example, a lens, a charge-coupled device (CCD) sensor serving as photoelectric conversion elements, and a drive circuit for the CCD sensor. An image signal output from the image reading unit 111 is subjected to various correction processing operations by an image processing unit 112, which is configured with a hardware device such as an application specific integrated circuit (ASIC), and is then output to the image printing device 301. In the above-described way, reading of a document is performed. Thus, the document feeding device 201 and the reading device 202 function as a document reading device.

Moreover, document reading modes include a first reading mode and a second reading mode. The first reading mode is a mode which reads the image of a document conveyed at a fixed speed with the illumination system 209 and the optical system, which are fixed at respective predetermined positions. The second reading mode is a mode which reads the image of a document placed on the document glass plate 214 of the reading device 202 with the illumination system 209 and the optical system, which move at respective fixed speeds. Usually, the image of a sheet-like document is read in the first reading mode, and the image of a bound document, such as a book or a brochure, is read in the second reading mode.

Sheet storage trays 302 and 304 are provided inside the image printing device 301. The sheet storage trays 302 and 304 allow respective different types of recording media to be stored therein. For example, sheets of plain paper of A4 size are stored in the sheet storage tray 302, and sheets of heavy paper of A4 size are stored in the sheet storage tray 304. Furthermore, the recording medium is a medium on which an image is able to be formed by an image forming apparatus, and examples of the recording medium include paper, a resin sheet, cloth, an overhead projector (OHP) sheet, and a label.

A recording medium stored in the sheet storage tray 302 is fed by a sheet feeding roller 303 and is then conveyed to a registration roller 308 by a conveyance roller 306. Moreover, a recording medium stored in the sheet storage tray 304 is fed by a sheet feeding roller 305 and is then conveyed to the registration roller 308 by a conveyance roller 307 and the conveyance roller 306.

The image signal output from the reading device 202 is input to an optical scanning device 311, which includes a semiconductor laser and a polygon mirror.

Moreover, the outer circumferential surface of a photosensitive drum 309 is electrically charged by a charging device 310. After the outer circumferential surface of the photosensitive drum 309 is electrically charged, laser light corresponding to the image signal input to the optical scanning device 311 from the reading device 202 is radiated from the optical scanning device 311 onto the outer circumferential surface of the photosensitive drum 309 via the polygon mirror and mirrors 312 and 313. As a result, an electrostatic latent image is formed on the outer circumferential surface of the photosensitive drum 309. Furthermore, a charging method using a corona charger or a charging roller is used to perform electrical charging of the photosensitive drum.

Next, the electrostatic latent image is developed with toner contained in a developing device 314, so that a toner image is formed on the outer circumferential surface of the photosensitive drum 309. The toner image formed on the photosensitive drum 309 is transferred to a recording medium by a transfer charging device 315, which is provided at a position facing the photosensitive drum 309 (transfer position). The registration roller 308 conveys the recording medium to the transfer position in conformity with such transfer timing.

In the above-described way, the recording medium having the toner image transferred thereto is conveyed to a fixing device 318 by a conveyance belt 317 and is then heated and pressed by the fixing device 318, so that the toner image is fixed to the recording medium. In this manner, an image is formed on the recording medium by the image forming apparatus 100.

In a case where image formation is performed in a one-sided (simplex) printing mode, the recording medium having passed through the fixing device 318 is discharged to a sheet discharge tray (not illustrated) by sheet discharge rollers 319 and 324. Moreover, in a case where image formation is performed in a two-sided (duplex) printing mode, after fixing processing is performed on the first surface of the recording medium by the fixing device 318, the recording medium is conveyed to an inversion path 325 by the sheet discharge roller 319, a conveyance roller 320, and an inversion roller 321. After that, the recording medium is conveyed to the registration roller 308 again by conveyance rollers 322 and 323, so that an image is formed on the second surface of the recording medium in the above-described way. After that, the recording medium is discharged to the sheet discharge tray (not illustrated) by the sheet discharge rollers 319 and 324.

Moreover, in a case where a recording medium having an image formed on the first surface thereof is discharged face-down to outside the image forming apparatus 100, the recording medium having passed through the fixing device 318 is conveyed in a direction to move toward the conveyance roller 320 via the sheet discharge roller 319. After that, immediately before the trailing edge of the recording medium passes through the nip portion of the conveyance roller 320, the rotation of the conveyance roller 320 is reversed, so that the recording medium with the first surface thereof made face-down is discharged to outside the image forming apparatus 100 via the sheet discharge roller 324.

Thus far is the description of the configuration and functions of the image forming apparatus 100.

Figure 2:
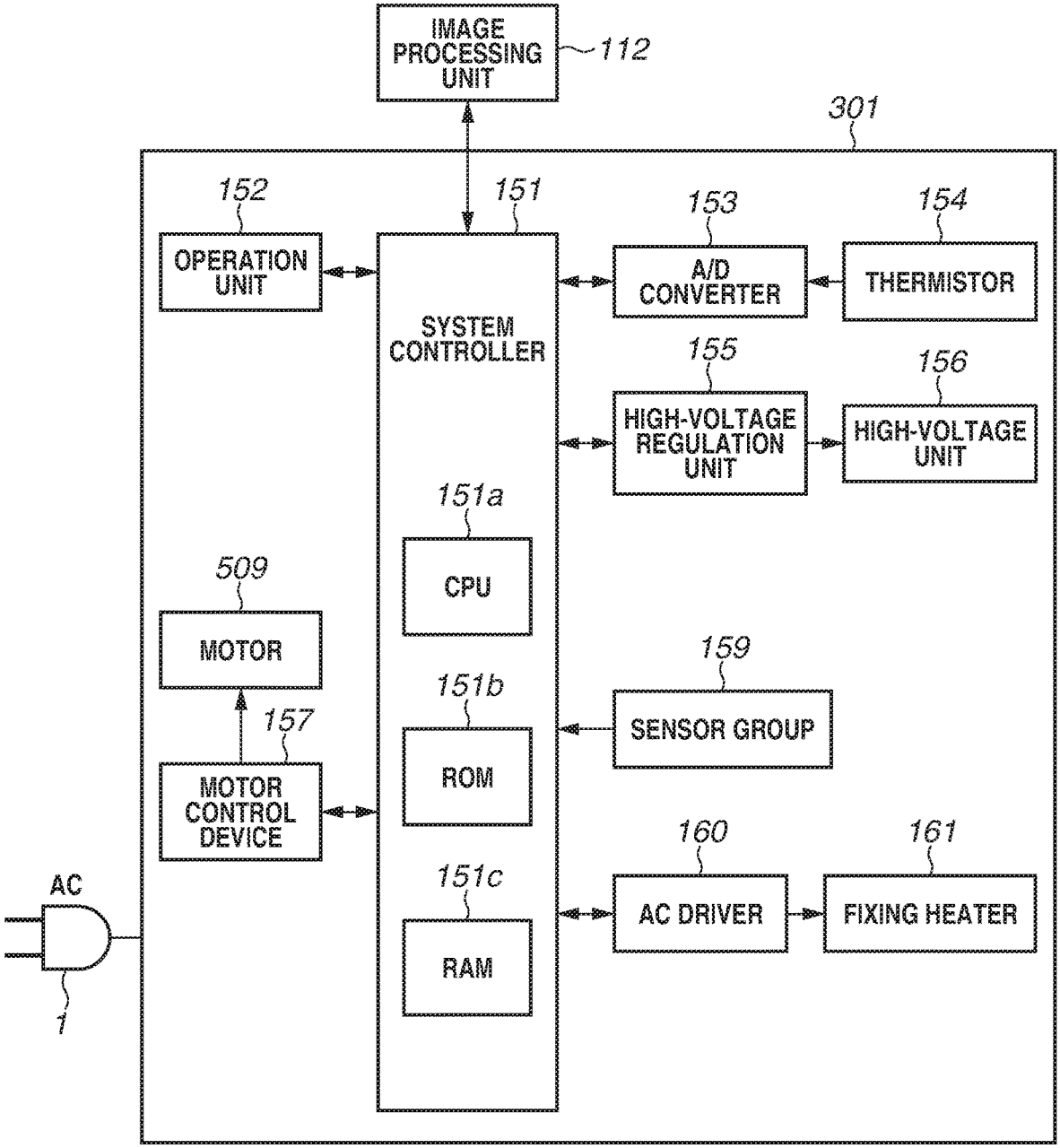
FIG. 2 is a block diagram illustrating a control configuration of the image forming apparatus according to the first exemplary embodiment.

FIG. 2 is a block diagram illustrating an example of a control configuration of the image forming apparatus 100. As illustrated in FIG. 2, the image forming apparatus 100 is connected to an alternating current power source 1 (AC) serving as a commercial power source, and the various devices incorporated in the image forming apparatus 100 operate with electric power supplied from the alternating current power source 1. A system controller 151 includes, as illustrated in FIG. 2, a central processing unit (CPU) 151*a*, a read-only memory (ROM) 151*b*, and a random access memory (RAM) 151*c*. Moreover, the system controller 151 is connected to the image processing unit 112, an operation unit 152, an analog-to-digital (A/D) converter 153, a high-voltage regulation unit 155, a motor control device 157, a sensor group 159, and an AC driver 160. The system controller 151 is able to transmit and receive data and commands to and from the respective units connected thereto.

The CPU 151*a* reads and executes various programs stored in the ROM 151*b*, thus performing various sequences related to a predetermined image forming sequence.

The RAM 151*c* is a storage device. For example, various pieces of data, such as a setting value to be set to the high-voltage regulation unit 155, an instruction value to be issued to the motor control device 157, and information received from the operation unit 152, are stored in the RAM 151*c*.

The system controller 151 transmits, to the image processing unit 112, pieces of setting value data for various devices provided inside the image forming apparatus 100, which are required for image processing to be performed by the image processing unit 112. Additionally, the system controller 151 receives signals from the sensor group 159, and sets a setting value for the high-voltage regulation unit 155 based on the received signals.

The high-voltage regulation unit 155 supplies a necessary voltage to a high-voltage unit 156 (for example, the charging device 310, the developing device 314, and the transfer charging device 315) according to the setting value set by the system controller 151.

The motor control device 157 controls a motor, which drives a load provided inside the image forming apparatus 100, according to an instruction output from the CPU 151*a*. Furthermore, while, in FIG. 2, only a motor 509 is illustrated as the motor provided in the image forming apparatus 100, actually, a plurality of motors is provided in the image forming apparatus 100. Moreover, a configuration in which a single motor control device controls a plurality of motors can be employed. Additionally, while, in FIG. 2, only one motor control device is illustrated, two or more motor control devices can be provided in the image forming apparatus 100.

The A/D converter 153 receives a detection signal output from a thermistor 154, which is provided for detecting the temperature of a fixing heater 161, converts the detection signal, which is an analog signal, into a digital signal, and then transmits the digital signal to the system controller 151. The system controller 151 controls the AC driver 160 based on the digital signal received from the A/D converter 153. The AC driver 160 controls the fixing heater 161 in such a manner that the temperature of the fixing heater 161 becomes a temperature required for performing fixing processing. Furthermore, the fixing heater 161 is a heater used for fixing processing, and is included in the fixing device 318.

The system controller 151 controls the operation unit 152 in such a way as to display, on a display portion provided in the operation unit 152, an operation screen used for the user to perform setting of, for example, the type of a recording medium (hereinafter referred to as a "paper type") to be used. The system controller 151 receives information set by the user from the operation unit 152, and controls an operation sequence of the image forming apparatus 100 based on the information set by the user. Moreover, the system controller 151 transmits information indicating the state of the image forming apparatus 100 to the operation unit 152. Furthermore, the information indicating the state of the image forming apparatus 100 is information about, for example, the number of images to be formed, the progress status of an image forming operation, and jam or double feed of sheet materials in the document feeding device 201 and the image printing device 301. The operation unit 152 displays the information received from the system controller 151 on the display portion.

In the above-described manner, the system controller 151 controls the operation sequence of the image forming apparatus 100.

<AC Driver>

Figure 3:
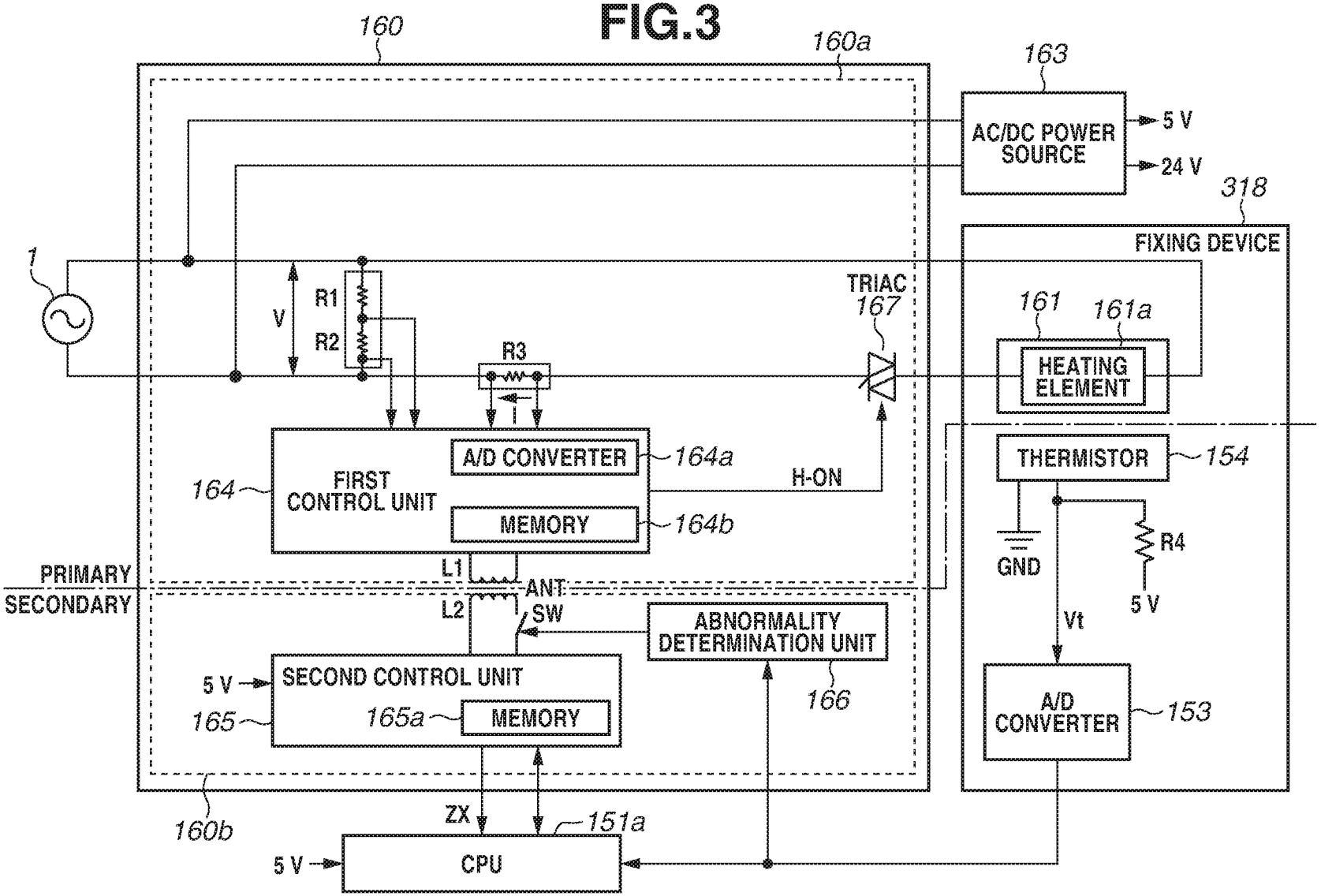
FIG. 3 is a control block diagram illustrating a configuration of an alternating current (AC) driver according to the first exemplary embodiment.

FIG. 3 is a block diagram illustrating a configuration of the AC driver 160. The AC driver 160 includes a first circuit 160*a*, which is connected to the alternating current power source 1, and a second circuit 160*b*, which is insulated from the first circuit 160*a*. Furthermore, as illustrated in FIG. 3, the first circuit 160*a* is included in the primary side in the AC driver 160, and the second circuit 160*b* is included in the secondary side in the AC driver 160.

The AC driver 160 includes a TRIAC (from triode for alternating current) 167, which controls supplying of electric power from the alternating current power source 1 to the fixing device 318, and a first control unit 164, which detects a voltage V supplied from the alternating current power source 1 and a current I flowing to the fixing heater 161 and then controls the TRIAC 167 based on a result of such detection.

As illustrated in FIG. 3, the first control unit 164 is insulated from a second control unit 165, the first control unit 164 is provided in the first circuit 160*a*, and the second control unit 165 is provided in the second circuit 160*b*. The first control unit 164 is electromagnetically coupled to the second control unit 165 by an antenna ANT. Moreover, the second control unit 165 is connected to the CPU 151*a*, and is controlled by the CPU 151*a*. Furthermore, the antenna ANT is described below.

As illustrated in FIG. 3, the voltage which is output from the alternating current power source 1 is also input to an AC/DC power source 163. The AC/DC power source 163 converts the alternating-current voltage output from the alternating current power source 1 into, for example, direct-current voltages of 5 V and 24 V and outputs such direct-current voltages. The direct-current voltage of 5 V is supplied to the CPU 151*a* and the second control unit 165. Moreover, the direct-current voltage of 24 V is supplied to a TRIAC driving circuit (not illustrated). The direct-current voltages of 5 V and 24 V are also supplied to various devices provided inside the image forming apparatus 100. Furthermore, any voltage which is output from the AC/DC power source 163 is not supplied to the first control unit 164. The first control unit 164 receives electric power supplied from the second control unit 165 via the antenna ANT while being in the state of being insulated from the second control unit 165. A specific configuration thereof is described below.

Upon receiving an H-ON signal='H' output from the first control unit 164, the TRIAC 167 enters an ON state. Moreover, upon receiving an H-ON signal='L' output from the first control unit 164, the TRIAC 167 enters an OFF state. As the TRIAC 167 is controlled, supplying of electric power to the fixing heater 161 is performed. The amount of electric power which is supplied to the fixing heater 161 is adjusted by timing at which the TRIAC 167 enters an ON state being controlled.

<Temperature Control of Fixing Heater>

In the subsequent direction, a method for controlling the temperature of the fixing heater 161 is described. The electric power output from the alternating current power source 1 is supplied via the AC driver 160 to a heating element 161*a* included in the fixing heater 161 provided in the fixing device 318.

The first control unit 164 detects the voltage V (a voltage V between both ends of a resistor R2) supplied from the alternating current power source 1. Moreover, the first control unit 164 detects the current I flowing to the heating element 161*a* based on a voltage between both ends of a resistor R3.

The first control unit 164 includes an A/D converter 164*a*, which converts the input voltage V and the input current I, which are analog values, into digital values. The first control unit 164 performs sampling of the voltage V and the current I, which have been converted by the A/D converter 164*a*, with a predetermined period T (for example, a period of 50 microseconds (μs)). Whenever performing sampling of the voltage V and the current I, the first control unit 164 performs summation of $V^2$, $I^2$, and V*I as expressed by the following equations (1) to (3).

$$VSUM=\Sigma V(n)^2 \quad (1)$$

$$ISUM=\Sigma I(n)^2 \quad (2)$$

$$VISUM=\Sigma V(n)I(n) \quad (3)$$

The first control unit 164 stores the values VSUM, ISUM, and VISUM obtained by summation (the integrated values) in a memory 164*b*.

Moreover, the first control unit 164 detects timing at which the voltage V changes from a negative value to a positive value (hereinafter referred to as "zero-cross timing").

Moreover, upon detecting the zero-cross timing, the first control unit 164 calculates an effective value Vrms of the voltage V, an effective value Irms of the current I, and an effective value Prms of V*I (=P) with use of the following equations (4) to (6).

$$Vrms = \sqrt{\frac{1}{N}\sum_{n=1}^{N} V(n)^2} \quad (4)$$

$$Irms = \sqrt{\frac{1}{N}\sum_{n=1}^{N} I(n)^2} \quad (5)$$

$$Prms = \frac{1}{N}\sum_{n=1}^{N} V(n)I(n) \quad (6)$$

The first control unit 164 stores the calculated effective values Vrms, Irms, and Prms in the memory 164*b*. Furthermore, whenever calculating the effective values Vrms, Irms, and Prms, the first control unit 164 resets the integrated values of $V^2$, $I^2$, and V*I previously stored in the memory 164*b*.

Moreover, upon detecting the zero-cross timing, the first control unit 164 communicates the effective values Vrms, Irms, and Prms stored in the memory 164*b* and the zero-cross timing being reached to the second control unit 165 via the antenna ANT with use of a method described below.

The second control unit 165 stores the effective values Vrms, Irms, and Prms acquired from the first control unit 164 in a memory 165*a*. Moreover, the second control unit 165 communicates the zero-cross timing being reached to the CPU 151*a* (a signal ZX).

Upon receiving communication of the zero-cross timing being reached from the second control unit 165, the CPU 151*a* acquires the effective values Vrms, Irms, and Prms stored in the memory 165*a* of the second control unit 165. In this way, the CPU 151*a* acquires the effective values Vrms, Irms, and Prms each time the zero-cross timing is reached. Thus, in the present exemplary embodiment, the signal ZX is a signal serving as a trigger used for the CPU 151*a* to acquire the effective values Vrms, Irms, and Prms.

The thermistor 154, which is used to detect the temperature of the fixing heater 161, is provided near the fixing heater 161. As illustrated in FIG. 3, the thermistor 154 is connected to ground (GND). The thermistor 154 has such a property that, for example, as its temperature becomes higher, its resistance value becomes lower. When the temperature of the thermistor 154 changes, the voltage Vt between both ends of the thermistor 154 also changes. Detecting such a voltage Vt enables detecting the temperature of the fixing heater 161.

The voltage Vt, which is an analog signal, output from the thermistor 154 is input to the A/D converter 153. The A/D converter 153 converts the voltage Vt, which is an analog signal, into a digital signal, and outputs the digital signal to the CPU 151*a* and an abnormality determination unit 166.

The CPU 151*a* controls the TRIAC 167 via the second control unit 165 based on the effective values Vrms, Irms, and Prms acquired from the second control unit 165 and the voltage Vt output from the A/D converter 153, thus controlling the temperature of the fixing heater 161. In the subsequent description, a specific method for controlling the temperature of the fixing heater 161 is described.

Figure 4:
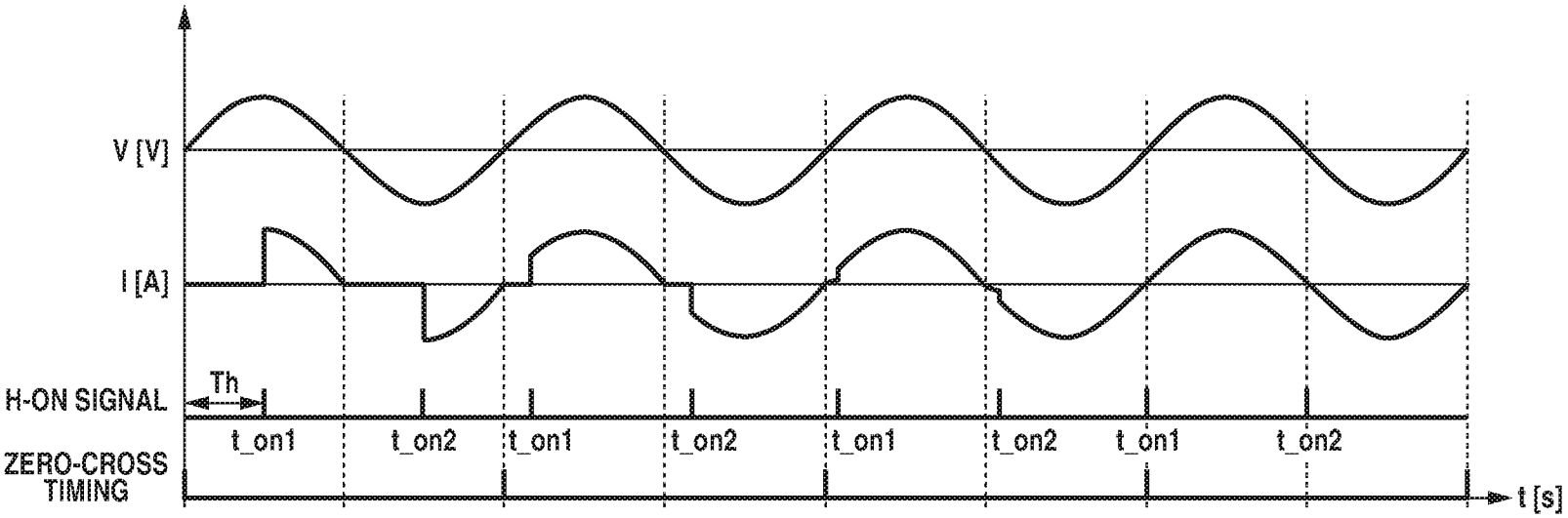
FIG. 4 is a timing chart illustrating a voltage V of an alternating current power source, a current I which flows through a heating element, an H-ON signal which is output from a control unit, and zero-cross timing.

FIG. 4 is a timing chart illustrating the voltage V of the alternating current power source 1, the current I flowing to the heating element 161*a*, the H-ON signal output from the first control unit 164, and zero-cross timing. As illustrated in FIG. 4, the period Tzx of zero-cross timing corresponds to the period of the voltage of the alternating current power source 1.

As illustrated in FIG. 4, as the time Th from zero-cross timing until timing t_on1 at which the H-ON signal='H' is output is controlled, the amount of current flowing to (the amount of electric power supplied to) the heating element 161*a* is controlled. Specifically, for example, as the time Th is shorter, the amount of current flowing to the heating element 161*a* becomes larger. Thus, as the time Th is controlled in such a way as to become shorter, the temperature of the fixing heater 161 increases.

In the present exemplary embodiment, the CPU 151*a* controls the amount of current flowing to the heating element 161*a* by controlling the time from zero-cross timing to the timing t_on1. As a result, the CPU 151*a* is able to control the temperature of the fixing heater 161. Furthermore, in the present exemplary embodiment, the TRIAC 167 is controlled in such a manner that a current the amount of which is the same as the amount of current flowing due to the H-ON signal='H' being output at the timing t_on1 and the polarity of which is opposite to that of the flowing current flows to the heating element 161*a*. Specifically, as illustrated in FIG. 4, the H-ON signal='H' is also output even at timing t_on2, which is timing at which a time Tzx/2 has elapsed from the timing t_on1, (in other words, at timing after the half cycle of the voltage of the alternating current power source 1).

Figure 5:
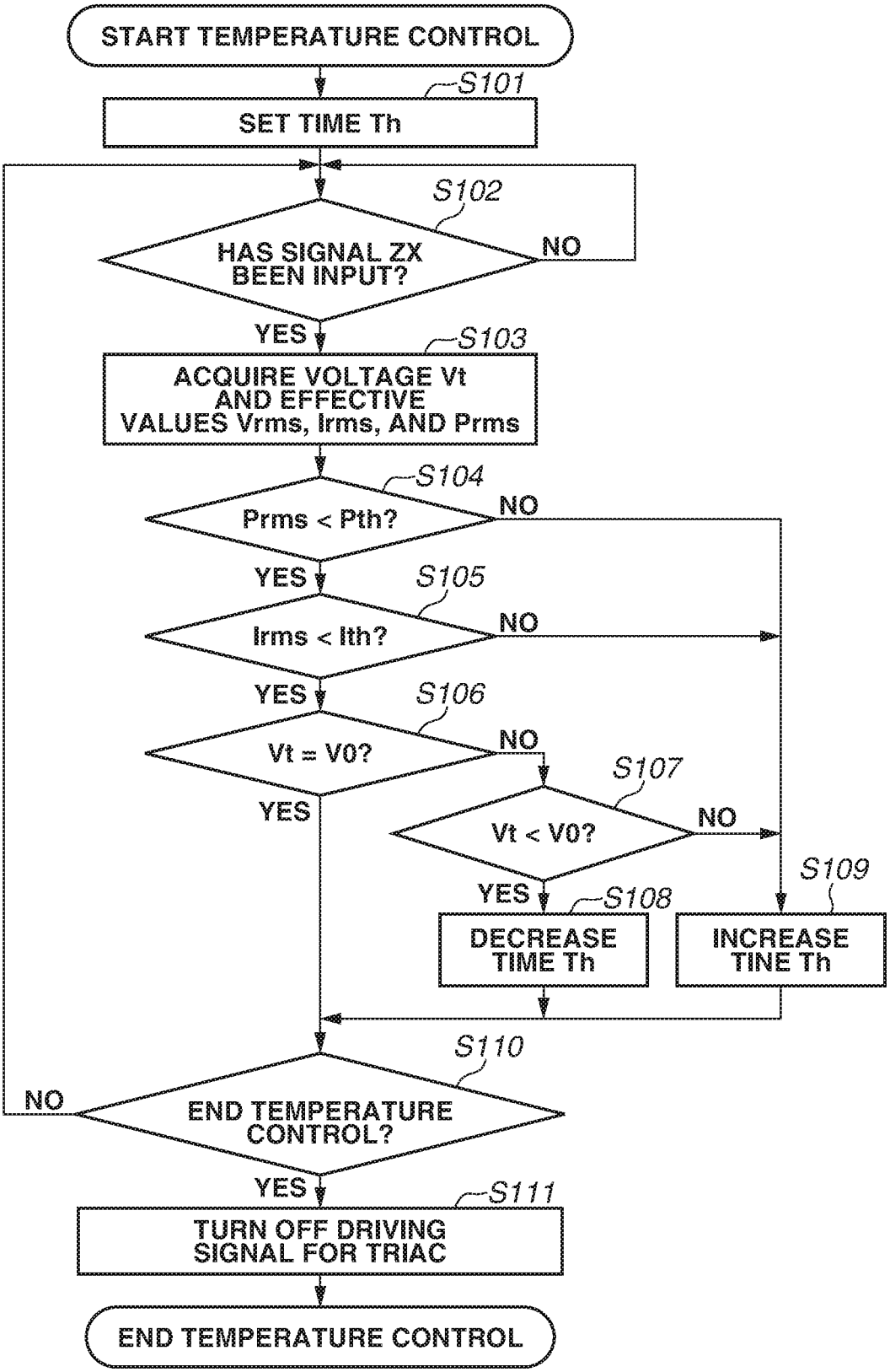
FIG. 5 is a flowchart illustrating a method for controlling the temperature of a fixing heater according to the first exemplary embodiment.

FIG. 5 is a flowchart illustrating a method for controlling the temperature of the fixing heater 161. In the subsequent description, the temperature control for the fixing heater 161 in the present exemplary embodiment is described with reference to FIG. 5. Processing in the flowchart of FIG. 5 is performed by the CPU 151*a*. Furthermore, processing in the flowchart of FIG. 5 is performed, for example, when the image forming apparatus 100 is started up.

In step S101, the CPU 151*a* sets the time Th, for example, based on a difference value between the voltage Vt acquired from the A/D converter 153 and a voltage V0 corresponding to the target temperature of the fixing heater 161, and communicates the time Th to the first control unit 164 via the second control unit 165 and the antenna ANT. As a result, the first control unit 164 outputs the H-ON signal to the TRIAC 167 based on the set time Th.

Then, if, in step S102, it is determined that the signal ZX has been input from the second control unit 165 to the CPU 151*a* (YES in step S102), then in step S103, the CPU 151*a* acquires the voltage Vt output from the A/D converter 153 and the effective values Vrms, Irms, and Prms stored in the memory 165*a* of the second control unit 165.

Then, if, in step S104, it is determined that the effective value Prms of electric power is greater than or equal to a threshold value Pth (Prms≥Pth) (NO in step S104), then in step S109, the CPU 151*a* outputs an instruction to increase the currently-set time Th to the first control unit 164 via the second control unit 165 and the antenna ANT. Furthermore, the amount of time by which to increase the time Th can be a previously determined amount, or can be determined based on a difference value between the effective value Prms and the threshold value Pth.

In this way, since the time Th is set in such a manner that, in a case where the effective value Prms of electric power is greater than or equal to the threshold value Pth, the effective value Prms becomes less than the threshold value Pth, it is possible to prevent or reduce excess electric power from being supplied to the fixing heater 161. As a result, it is possible to prevent or reduce power consumption from increasing. Furthermore, the threshold value Pth is set to a value greater than the value of electric power which is able to increase the temperature of the fixing heater 161 up to the target temperature.

After that, the processing proceeds to step S110.

Moreover, if, in step S104, it is determined that the effective value Prms of electric power is less than the threshold value Pth (Prms<Pth) (YES in step S104), the processing proceeds to step S105.

If, in step S105, it is determined that the effective value Irms of current is greater than or equal to a threshold value Ith (Irms≥Ith) (NO in step S105), then in step S109, the CPU 151*a* outputs an instruction to increase the currently-set time Th to the first control unit 164 via the second control unit 165 and the antenna ANT. Furthermore, the amount of time by which to increase the time Th can be a previously determined amount, or can be determined based on a difference value between the effective value Irms and the threshold value Ith.

In this way, since the time Th is controlled in such a manner that, in a case where the effective value Irms is greater than or equal to the threshold value Ith, the effective value Irms becomes less than the threshold value Ith, it is possible to prevent or reduce excess current from being supplied to the heating element 161*a*. As a result, it is possible to prevent or reduce the temperature of the fixing heater 161 from excessively increasing. Furthermore, the threshold value Ith is set to a value greater than the value of current which is able to increase the temperature of the fixing heater 161 up to the target temperature.

After that, the processing proceeds to step S110.

Moreover, if, in step S105, it is determined that the effective value Irms is less than the threshold value Ith (Irms<Ith) (YES in step S105), the processing proceeds to step S106.

If, in step S106, it is determined that the voltage Vt acquired from the A/D converter 153 is equal to the voltage V0 corresponding to the target temperature of the fixing heater 161 (YES in step S106), the processing proceeds to step S110.

Moreover, if in step S106, it is determined that the voltage Vt acquired from the A/D converter 153 is not equal to the voltage V0 corresponding to the target temperature of the fixing heater 161 (NO in step S106), the processing proceeds to step S107.

If, in step S107, it is determined that the voltage Vt is greater than the voltage V0 (NO in step S107), then in step S109, the CPU 151*a* outputs an instruction to increase the currently-set time Th in such a manner that a deviation between the voltage Vt and the voltage V0 becomes smaller, to the first control unit 164 via the second control unit 165 and the antenna ANT. Furthermore, the amount of time by which to increase the time Th can be a previously determined amount, or can be determined based on a difference value between the voltage Vt and the voltage V0.

Moreover, if in step S107, it is determined that the voltage Vt is less than the voltage V0 (YES in step S107), then in step S108, the CPU 151*a* outputs an instruction to decrease the currently-set time Th in such a manner that a deviation between the voltage Vt and the voltage V0 becomes smaller, to the first control unit 164 via the second control unit 165 and the antenna ANT. Furthermore, the amount of time by which to decrease the time Th can be a previously determined amount, or can be determined based on a difference value between the voltage Vt and the voltage V0.

If, in step S110, it is determined to continue the temperature control (in other words, to continue a print job) (NO in step S110), the processing returns to step S102.

Moreover, if, in step S110, it is determined to end the temperature control (in other words, to end a print job) (YES in step S110), then in step S111, the CPU 151*a* controls the second control unit 165 in such a way as to stop driving of the TRIAC 167.

Furthermore, for example, the amount of change of electric power which changes due to the time Th being increased differs between cases where the effective value of voltage is, for example, 100 V and 80 V. Specifically, the amount of change of electric power which changes due to the time Th being increased in a case where the effective value of voltage is 100 V is larger than the amount of change of electric power which changes due to the time Th being increased in a case where the effective value of voltage is 80 V. The CPU 151*a* controls the time Th based on the effective value Vrms of voltage.

Thus far is the method for controlling the temperature of the fixing heater 161.

<Antenna ANT>

{Supplying of Electric Power from Second Control Unit to First Control Unit}

The first control unit 164, which is provided in the first circuit 160*a*, is insulated from the second control unit 165, which is provided in the second circuit 160*b*, and is electromagnetically coupled to the second control unit 165 by the antenna ANT, which is composed of a coil (winding) L1 serving as a first communication unit and a coil (winding) L2 serving as a second communication unit. An amplitude-modulated signal of high frequency (for example, 13.56 MHz) is output to the coil L2. Alternating current corresponding to the amplitude-modulated signal flows through the coil L2, and an alternating-current magnetic field generated in the coil L2 due to the alternating current flowing therethrough causes an alternating-current voltage to be generated in the coil L1. The first control unit 164 operates with the alternating-current voltage generated in the coil L1. In this way, in the present exemplary embodiment, electric power is supplied from the second control unit 165 to the first control unit 164 via the antenna ANT. As a result, since the first circuit 160*a* does not need to include a power source used for the first control unit 164 to operate, it is possible to prevent or reduce an increase in size of the apparatus and an increase in cost. Furthermore, the second control unit 165 supplies electric power to the first control unit 164, for example, with a period shorter than a period with which the first control unit 164 detects the voltage V and the current I. Moreover, the second control unit 165 does not need to supply electric power to the first control unit 164 during a period in which the image forming apparatus 100 is in sleep mode.

{Data Communication Between First Control Unit and Second Control Unit}

Figure 6:
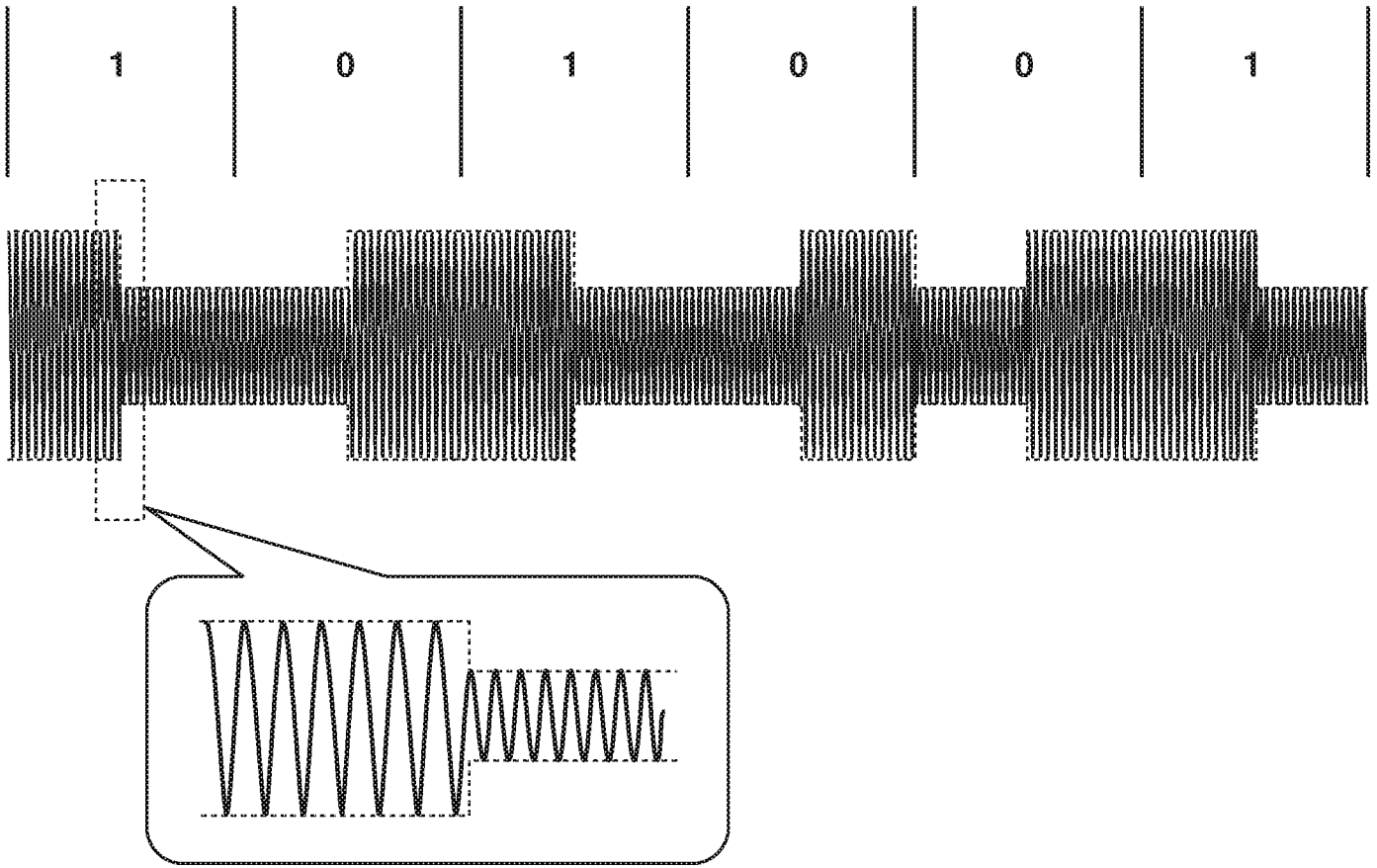
FIG. 6 is a diagram illustrating a modulation wave which has been amplitude-modulated.

FIG. 6 is a diagram illustrating an amplitude-modulated signal. As illustrated in FIG. 6, each of signals indicating "0" and "1" is represented by a combination of a signal having a first amplitude and a signal having a second amplitude smaller than the first amplitude. For example, with regard to a signal indicating "1", the first half of one bit is represented by the signal having the first amplitude, and the latter half of one bit is represented by the signal having the second amplitude. Moreover, with regard to a signal indicating "0", the first half of one bit is represented by the signal having the second amplitude, and the latter half of one bit is represented by the signal having the first amplitude.

The amplitude-modulated signal such as that illustrated in FIG. 6 is output to the coil L2. As a result, a signal corresponding to the signal output to the coil L2 is generated in the coil L1.

The first control unit 164 varies the resistance value of a variable resistor provided in the first control unit 164 according to data which is to be transmitted to the second control unit 165. As a result, a signal which is generated in the coil L1 is varied due to the impedance of the coil L1 being varied, so that data is transmitted to the second control unit 165. The first control unit 164 transmits data to the second control unit 165 by superposing data on a signal generated in the coil L1 in the above-descried way. Furthermore, the data corresponds to, for example, the effective values Vrms, Irms, and Prms and the signal ZX indicating zero-cross timing.

The second control unit 165 extracts, from a signal generated in the coil L2 due to the first control unit 164 superposing data on a signal generated in the coil L1, the superposed data. Specifically, the second control unit 165 reads data from the first control unit 164 by detecting a change in the signal generated in the coil L2 due to the first control unit 164 varying the impedance of the coil L1 when superposing data on the signal generated in the coil L1.

In this way, the first control unit 164 transmits data to the second control unit 165, which is electromagnetically coupled to the first control unit 164 via the antenna ANT. In other words, the first control unit 164 transmits data to the second control unit 165 by wireless communication using the coil L1 and the coil L2.

Furthermore, the second control unit 165 transmits, to the first control unit 164, data about, for example, the time Th by modulating the amplitude of a signal to be output to the coil L2.

In the above-described way, in the present exemplary embodiment, the first control unit 164, which is provided in the first circuit 160*a*, is insulated from the second control unit 165, which is provided in the second circuit 160*b*, and is electromagnetically coupled to the second control unit 165 via the antenna ANT, which is composed of the coil L1 and the coil L2. Specifically, an alternating-current magnetic field generated in the coil L2 due to an alternating current flowing through the coil L2 according to a signal output from the second control unit 165 causes an alternating-current voltage to be generated in the coil L1. The first control unit 164 operates with an alternating-current voltage generated in the coil L1. In this way, in the present exemplary embodiment, electric power is supplied from the second control unit 165 to the first control unit 164 via the antenna ANT. As a result, since the first circuit 160*a* does not need to include a power source used for the first control unit 164 to operate, it is possible to prevent or reduce an increase in size of the apparatus and an increase in cost while maintaining an insulating state between the first circuit 160*a* and the second circuit 160*b*.

Moreover, in the present exemplary embodiment, the first control unit 164 transmits data to the second control unit 165, for example, by varying the impedance of the coil L1 to vary a signal generated in the coil L1. Then, the second control unit 165 reads data from the first control unit 164 by detecting the varied signal. In this way, the first control unit 164 transmits data to the second control unit 165, which is electromagnetically coupled to the first control unit 164 via the antenna ANT. Moreover, the second control unit 165 transmits, to the first control unit 164, data about, for example, the time Th by modulating the amplitude of a signal to be output to the coil L2.

<Control of Supplying of Electric Power to First Control Unit>

The voltage Vt output from the A/D converter 153 is input to the second control unit 165. When determining that the voltage Vt is lower than or equal to a threshold voltage Vth (the temperature of the fixing heater 161 is higher than or equal to a threshold temperature), the second control unit 165 stops outputting an alternating current to the coil L2. As a result, supplying of electric power to the first control unit 164 via the antenna ANT is stopped, so that control of the TRIAC 167 by the first control unit 164 is stopped. Thus, supplying of electric power to the fixing heater 161 is stopped. As a result, it is possible to prevent or reduce power consumption from increasing due to excess electric power being supplied to the fixing heater 161 in the event of a malfunction of the first control unit 164. In other words, it is possible to prevent or reduce power consumption from increasing even when the first circuit 160*a* malfunctions.

Moreover, the voltage Vt output from the A/D converter 153 is also input to the abnormality determination unit 166. When determining that the voltage Vt is lower than or equal to the threshold voltage Vth (the temperature of the fixing heater 161 is higher than or equal to the threshold temperature), the abnormality determination unit 166 controls a switch SW in such a way as to block off an alternating current to be output from the second control unit 165 to the coil L2 (blocking state). Specifically, for example, when determining that the voltage Vt is lower than or equal to the threshold voltage Vth, the abnormality determination unit 166 stops supplying electric current to a coil (not illustrated) for varying the state of the switch SW. When supplying of electric current to such a coil is stopped, the switch SW enters the blocking state. As a result, supplying of electric power to the first control unit 164 via the antenna ANT is stopped, so that control of the TRIAC 167 by the first control unit 164 is stopped. Thus, supplying of electric power to the fixing heater 161 is stopped. As a result, it is possible to prevent or reduce power consumption from increasing due to excess electric power being supplied to the fixing heater 161 in the event of a malfunction of the first control unit 164. In other words, it is possible to prevent or reduce power consumption from increasing even when the first circuit 160*a* malfunctions. Furthermore, in a case where the voltage Vt is higher than the threshold voltage Vth, the switch SW is controlled in such a manner that an alternating current output from the second control unit 165 is supplied to the coil L2 (supplying state). During a period in which electric current is supplied to the coil L2, the switch SW is in the supplying state.

As described above, in the present exemplary embodiment, both the second control unit 165 and the abnormality determination unit 166 include a configuration which stops supplying of electric power to the first control unit 164 via the antenna ANT. As a result, in a case where the first circuit 160*a* has malfunctioned, even if any one of the second control unit 165 and the abnormality determination unit 166 malfunctions, supplying of electric power to the first control unit 164 via the antenna ANT is stopped. As a result, control of the TRIAC 167 by the first control unit 164 is stopped, so that supplying of electric power to the fixing heater 161 is stopped. As a result, it is possible to prevent or reduce power consumption from increasing due to excess electric power being supplied to the fixing heater 161 in the event of a malfunction of the first control unit 164. In other words, it is possible to prevent or reduce power consumption from increasing even when the first circuit 160*a* malfunctions.

Furthermore, while, in the present exemplary embodiment, in a case where the voltage Vt is lower than or equal to the threshold voltage Vth, outputting of a signal to the coil L2 is stopped in such a way as to prevent electric power from being supplied from the second control unit 165 to the first control unit 164, the present exemplary embodiment is not limited to this. For example, the switch SW can be controlled in such a manner that, in a case where the voltage Vt is lower than or equal to the threshold voltage Vth, an alternating current which the second control unit 165 outputs to the coil L2 is blocked off. Thus, a configuration in which outputting of a signal to the coil L2 is controlled in such a manner that, in a case where the voltage Vt is lower than or equal to the threshold voltage Vth, electric power is not supplied from the second control unit 165 to the first control unit 164 only needs to be employed.

Moreover, while, in the present exemplary embodiment, the abnormality determination unit 166 controls the switch SW, the present exemplary embodiment is not limited to this. For example, a configuration in which the CPU 151*a* controls the switch SW based on the voltage Vt can also be employed.

Furthermore, a configuration in which the function of the CPU 151*a* in the present exemplary embodiment is included in the second control unit 165 can be employed, or a configuration in which the function of the second control unit 165 is included in the CPU 151*a* can be employed.

For example, the voltage V and the current I in the present exemplary embodiment correspond to parameters about electric power to be supplied to a load.

Moreover, the TRIAC 167 in the present exemplary embodiment is included in a TRIAC circuit.

Moreover, while, in the present exemplary embodiment, the CPU 151*a* acquires the effective values in response to the signal ZX being input thereto, the present exemplary embodiment is not limited to this. For example, a configuration in which the CPU 151*a* acquires the effective values when the time measured by a timer provided in the CPU 151*a* reaches a time corresponding to one period of the voltage V can be employed. Thus, a configuration in which the signal ZX is input from the second control unit 165 to the CPU 151*a* does not need to be employed.

Moreover, while, in the present exemplary embodiment, the TRIAC 167 is used as a configuration which adjusts electric power to be supplied to the heating element 161*a*, the present exemplary embodiment is not limited to this. For example, a configuration which adjusts electric power to be supplied to the heating element 161*a* by varying the resistance of a circuit in the first circuit 160*a* to modulate the amplitudes of the voltage and current to be supplied to the heating element 161*a* can be employed.

Moreover, while, in the present exemplary embodiment, the first control unit 164 transmits data to the second control unit 165 by varying the impedance of the coil L1 to modulate the amplitude of a signal to be generated in the coil L1, the present exemplary embodiment is not limited to this. For example, a configuration in which the first control unit 164 transmits data to the second control unit 165 by modulating the frequency of a signal to be generated in the coil L1 can be employed.

Moreover, while, in the present exemplary embodiment, near field communication (NFC) is used as a method of performing wireless communication between the first control unit 164 and the second control unit 165, the method of performing wireless communication between the first control unit 164 and the second control unit 165 is not limited to this. For example, infrared communication can be used as a method of performing wireless communication between the first control unit 164 and the second control unit 165.

Moreover, while, in the present exemplary embodiment, the first circuit 160*a* is connected to a commercial power source, the present exemplary embodiment is not limited to this. For example, a configuration in which the first circuit 160*a* is connected to a predetermined power source, such as a battery, can be employed.

Furthermore, the first control unit 164 and the coil L1 are included in a first communication unit, and the first control unit 164 is included in a transmission unit. Moreover, the coil L2 is included in a second communication unit. Moreover, the resistor R3 is included in a detection unit.

Furthermore, while, in the present exemplary embodiment, a configuration in which temperature control for the fixing heater 161 serving as a load to which electric power is supplied from a commercial power source is performed has been described, an object used as a load is not limited to the fixing heater 161. For example, the photosensitive drum 309 can be used as a load to which electric power is supplied from a commercial power source.

According to an exemplary embodiment of the disclosure, it is possible to prevent or reduce power consumption from increasing even when the first circuit malfunctions.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-176291 filed Sep. 20, 2018, which is hereby incorporated by reference herein in its entirety.

What is claimed is:

1. A power supply device comprising:

a first circuit connected to a predetermined power source, the first circuit comprising:

a heater;

an adjustment unit configured to adjust electric power to be supplied from the predetermined power source to the heater;

a first controller configured to control the adjustment unit;

a first detector configured to detect a parameter about electric power supplied to the heater; and a first communication unit connected to the first controller;

a second circuit insulated from the first circuit, the second circuit comprising:

a second communication unit insulated from the first communication unit, and configured to perform wireless communication with the first communication unit; and a second controller connected to the second communication unit; and a discriminator configured to discriminate whether the first circuit is in an abnormal state or not; and a second detector configured to detect a temperature of the heater, wherein the first controller is operated by electric power supplied thereto by a voltage generated in the first communication unit due to a voltage output from the second controller to the second communication unit, wherein the first controller transmits information about a result of detection by the first detector to the second controller by the wireless communication, wherein the second controller supplies, to the first controller via the first communication unit and the second communication unit, a first signal for reducing a deviation between a target temperature of the heater and the temperature detected by the second detector based on the information transmitted from the first controller to the second controller, wherein the first controller controls the adjustment unit based on the first signal, and wherein, in a case where the discriminator discriminates that the first circuit is in the abnormal state, supplying of the electric power to the first controller is blocked off.

2. The power supply apparatus according to claim 1, wherein the first controller transmits the information by using a signal generated in the first communication unit due to the voltage output from the second controller to the second communication unit.

3. The power supply device according to claim 1, further comprising:

a switch unit configured to switch between a supplying state in which the voltage is supplied from the second controller to the second communication unit and a blocking state in which the voltage is not supplied from the second controller to the second communication unit; and a third controller configured to control the switch unit in such a manner that, in a case where the discriminator discriminates that the first circuit is in the abnormal state, the switch unit enters the blocking state.

4. The power supply device according to claim 1, wherein, in a case the discriminator discriminates that the first circuit is in the abnormal state, the second controller stops supplying of the voltage to the second communication unit.

5. The power supply device according to claim 1, wherein the predetermined power source is a commercial power source.

6. The power supply device according to claim 1, wherein the parameter about electric power is a current supplied to the heater, and wherein the second controller supplies, to the first controller, a signal for reducing electric power to be supplied to the heater in a case where an effective value of the current detected by the first detector is larger than a predetermined value.

7. The power supply device according to claim 1, wherein the second controller supplies, to the first controller, a signal for reducing electric power to be supplied to the heater in a case where an effective value of electric power determined based on the result of detection by the first detector is larger than a second predetermined value.

8. The power supply device according to claim 1, wherein the first detector detects a voltage supplied from the predetermined power source, and wherein the second controller supplies, to the first controller, a signal for reducing electric power supplied to the heater based on an effective value of the voltage detected by the first detector.

9. The power supply device according to claim 1, wherein the adjustment unit is a TRIAC circuit, and wherein the first controller increases a period in which the TRIAC circuit is in an ON state in a case of increasing electric power to be supplied to the heater, and decreases a period in which the TRIAC circuit is in an ON state in a case of decreasing electric power to be supplied to the heater.

10. The power supply device according to claim 1, wherein the first communication unit includes:

a first antenna including a winding; and a transmission unit configured to transmit the information by controlling an impedance of the winding included in the first antenna, wherein the second communication unit includes a second antenna including a winding, and wherein wireless communication between the first communication unit and the second communication unit is performed by the first antenna and the second antenna.

11. The power supply device according to claim 10, wherein a variable resistor is connected to the winding included in the first antenna, and wherein the first communication unit controls the impedance of the winding included in the first antenna by varying a resistance value of the variable resistor.

12. The power supply apparatus according to claim 1, wherein the first communication unit includes a first antenna including a winding, wherein the second communication unit includes a second antenna including a winding, and wherein the first communication unit is operated by electric power supplied thereto by the voltage generated in the first antenna due to the voltage output from the second controller to the second antenna, the voltage generated in the first antenna being a voltage induced by the voltage output from the second controller to the second antenna.

13. The power supply device according to claim 1, wherein the first communication unit and the second communication unit perform wireless communication using near field communication (NFC).

14. The power supply device according to claim 1, wherein the first detector includes a resistor.

15. An image forming apparatus comprising:

a transfer unit configured to transfer a toner image to a sheet; and a fixing unit including a heater and a power supply device, and configured to fix, to the sheet, the toner image transferred to the sheet by the transfer unit, with use of heat generated by the heater;

wherein the power supply device includes:

a first circuit connected to a predetermined power source; the first circuit including:

the heater;

an adjustment unit configured to adjust electric power to be supplied from the predetermined power source to the heater;

a first controller configured to control the adjustment unit;

a first detector configured to detect a parameter about electric power supplied to the heater; and a first communication unit connected to the first controller;

a second circuit insulated from the first circuit, the second circuit including:

a second communication unit insulated from the first communication unit, and configured to perform wireless communication with the first communication unit; and a second controller connected to the second communication unit; and a discriminator configured to discriminate whether the first circuit is in an abnormal state or not; and a second detector configured to detect a temperature of the heater, wherein the first controller is operated by electric power supplied thereto by a voltage generated in the first communication unit due to a voltage output from the second controller to the second communication unit, wherein the first controller transmits information about a result of detection by the first detector to the second controller by the wireless communication, wherein the second controller supplies, to the first controller via the first communication unit and the second communication unit, a first signal for reducing a deviation between a target temperature of the heater and the temperature detected by the second detector based on the information transmitted from the first controller to the second controller, wherein the first controller controls the adjustment unit based on the first signal, and wherein, in a case where the temperature detected by the second detector is higher discriminator discriminates that the first circuit is in the abnormal state, supplying of the electric power to the first controller is blocked off.

16. The power supply apparatus according to claim 1, wherein, based on the temperature detected by the second detector, the discriminator discriminates whether the first circuit is in the abnormal state or not.

17. The power supply apparatus according to claim 1, wherein the first circuit being in the abnormal state corresponds to the temperature detected by the second detector being higher than a predetermined temperature which is higher than the target temperature, and wherein, in a case where the temperature detected by the second detector is higher than the predetermined temperature, the supplying of the electric power to the first controller is blocked off.

18. The image forming apparatus according to claim 15, wherein, based on the temperature detected by the second detector, the discriminator discriminates whether the first circuit is in the abnormal state or not.

19. The image forming apparatus according to claim 15, wherein the first circuit being in the abnormal state corresponds to the temperature detected by the second detector being higher than a predetermined temperature which is higher than the target temperature, and wherein, in a case where the temperature detected by the second detector is higher than the predetermined temperature, the supplying of the electric power to the first controller is blocked off.

* * * * *